US009958240B2

(12) United States Patent
Burgess

(10) Patent No.: US 9,958,240 B2
(45) Date of Patent: May 1, 2018

(54) BROADHEAD PINPUSHER FOR REPLACING BROADHEAD BLADES

(71) Applicant: Jason S. Burgess, Toledo, OH (US)

(72) Inventor: Jason S. Burgess, Toledo, OH (US)

( * ) Notice: Subject to any disclaimer, the term of this patent is extended or adjusted under 35 U.S.C. 154(b) by 151 days.

(21) Appl. No.: 14/756,703

(22) Filed: Oct. 1, 2015

(65) Prior Publication Data

US 2016/0138896 A1 May 19, 2016

Related U.S. Application Data

(60) Provisional application No. 62/071,727, filed on Oct. 1, 2014.

(51) Int. Cl.
*F42B 6/08* (2006.01)

(52) U.S. Cl.
CPC ..... *F42B 6/08* (2013.01); *Y10T 29/53991* (2015.01)

(58) Field of Classification Search
CPC ..... F42B 6/08; Y10T 29/53991
See application file for complete search history.

(56) References Cited

U.S. PATENT DOCUMENTS 4,283,829 A * 8/1981 Saunders ..... B25B 27/02 29/278
5,820,498 A * 10/1998 Maleski ..... F42B 6/08 473/584
9,157,710 B1 * 10/2015 Huntsman ..... F42B 6/08

* cited by examiner

*Primary Examiner* — John C Hong
(74) *Attorney, Agent, or Firm* — Timothy S. Stevens; Karen L. Kimble

(57) ABSTRACT

Apparatus for positioning the blade retaining pin of a broadhead arrow tip employing retracting blades retained by a pin, the apparatus employing various screws adapted to completely or partially remove the pin, to press the pin back into place flush with the tip as well as to install a new pin.

1 Claim, 2 Drawing Sheets

BROADHEAD PINPUSHER FOR REPLACING BROADHEAD BLADES

BACKGROUND OF THE INVENTION

The instant invention relates generally to archery products and more particularly to broadhead arrow tips employing retracting blades retained by a pin. Such broadhead arrow tips have movable blades that are stowed during flight and deploy upon impact. The blades are stowed during flight to provide reduced aerodynamic drag during flight. Upon impact the blades are deployed to an extended position that enlarges the cutting profile of the arrow tip. The blades of such broadhead arrow tips can become dull and/or chipped after use and can be replaced by driving the pin out of the tip with a pin punch, removing the old blades from the tip, inserting the new blades into position in the tip and then driving the pin back into place. The step of driving the pin back into place is usually accomplished by holding the pin in place with needle nose plyers while driving the pin into the tip with a hammer. The step of driving the pin back into place requires care to properly align the pin with the tip to prevent damage to the pin and/or the tip especially since the tip has a cylindrical shape which tends to roll as the pin is driven back into place. It would be an advance in the art if a device where discovered that better facilitated the step of driving such a pin back into place.

SUMMARY OF THE INVENTION

The instant invention is an important advance in the art of positioning the blade retaining pin of a broadhead arrow tip employing retracting blades retained by a pin. With regard to the preferred embodiment of the instant invention, the apparatus comprises a body, the body comprising a first bore therethrough, the first bore having a longitudinal axis, the body having a second bore therethrough, the second bore having a longitudinal axis, the longitudinal axis of the first and second bores intersecting at a right angle. The first bore is threaded near one end, the second bore is threaded. The body comprises a slot aligned with and intersecting with the longitudinal axis of the first bore. The apparatus further comprises a first screw adapted to be threaded into the threaded portion of the first bore. The body further comprises a third threaded bore thereinto and a fourth threaded bore thereinto. The thread diameter and pitch of the first, third and fourth threaded bores are the same. The apparatus also comprises a second screw, a third screw, a fourth screw and a fifth screw, the thread diameter and pitch of the second, third, fourth and fifth screws being the same as thread diameter and pitch of the first, third and fourth bores. The distal end of the second screw being flat, the distal end of the third screw comprising a bore thereinto along the longitudinal axis of the third screw, the distal end of the fourth screw comprising a pin shaped projection therefrom, the longitudinal axis of the pin shaped projection from the fourth screw being coincident with the longitudinal axis of the fourth screw, the length of the pin shaped projection from the fourth screw being less than the diameter of the first bore, the distal end of the fifth screw comprising a pin shaped projection therefrom, the longitudinal axis of the pin shaped projection from the fifth screw being coincident with the longitudinal axis of the fifth screw, the length of the pin shaped projection from the fifth screw being greater than the diameter of the first bore. When a broadhead arrow tip employing retracting blades retained by a pin is positioned in the first bore and the pin aligned with the longitudinal axis of the second bore by adjusting the first screw in the threaded portion of the first bore to bear against the distal end of the arrow tip, the blades of the arrow tip can be positioned in the slot. When it is desired to remove the pin from the tip, the fifth screw is screwed into the second bore so that the pin shaped projection from the fifth screw presses the pin from the tip. When it is desired to only press the pin from the tip sufficiently to remove the blades from the tip for replacement with new blades, the fourth screw is screwed into the second bore so that the pin shaped projection from the fourth screw presses the pin sufficiently to remove the blades from the tip for replacement with new blades and then the second screw is screwed into the first bore to press the pin back into place. Alternatively, when it is desired to press a new pin into the tip, a new pin can be positioned in the bore of the third screw and the third screw screwed into the first bore to press the pin into the tip. The third and fourth threaded bores are used for screw storage.

DETAILED DESCRIPTION OF THE INVENTION

Figure 1:
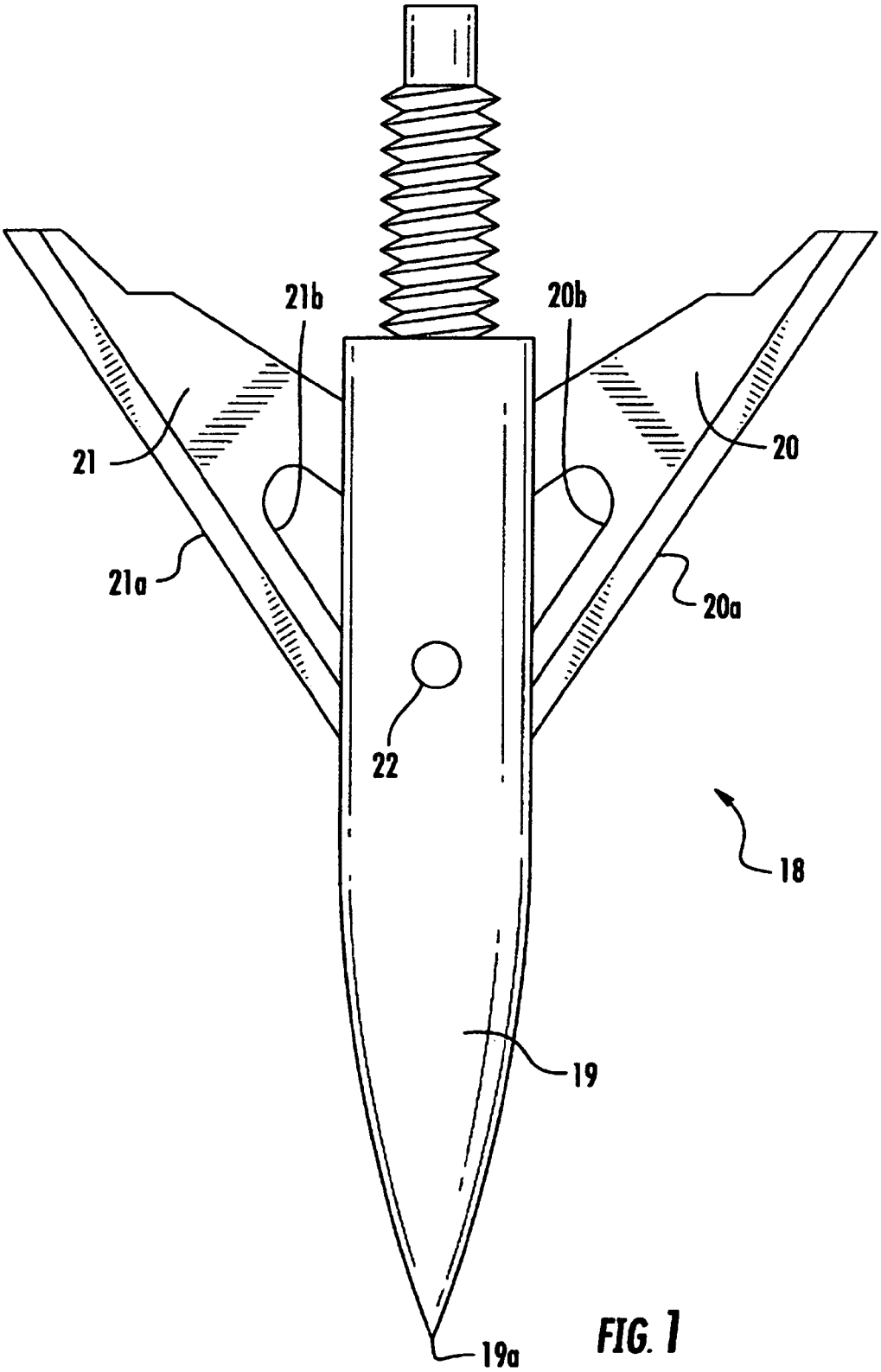
FIG. 1 is a side view of a broadhead arrow tip employing retracting blades retained by a pin showing the blades in the extended position.

Referring now to FIG. 1, therein is shown a typical broadhead arrow tip 18 employing retracting blades 20 and 21 retained by pin 22. The blades 20 and 21 have sharpened edges 20*a* and 21*a*. The pin 22 is a press fit in a bore that passes through the tip body 19. The blades 20 and 21 have openings 20*b* and 21*b*. The blades 20 and 21 overlap each other within the tip body 19 and pivot to a retracted or extended position about the pin 22 which pin passes through the openings 20*b* and 21*b* in the blades 20 and 21. The distal end 19*a* of the arrow tip 18 is pointed while the other end of the arrow tip 18 is threaded for attachment to the main shaft of an arrow or crossbow bolt.

Figure 2:
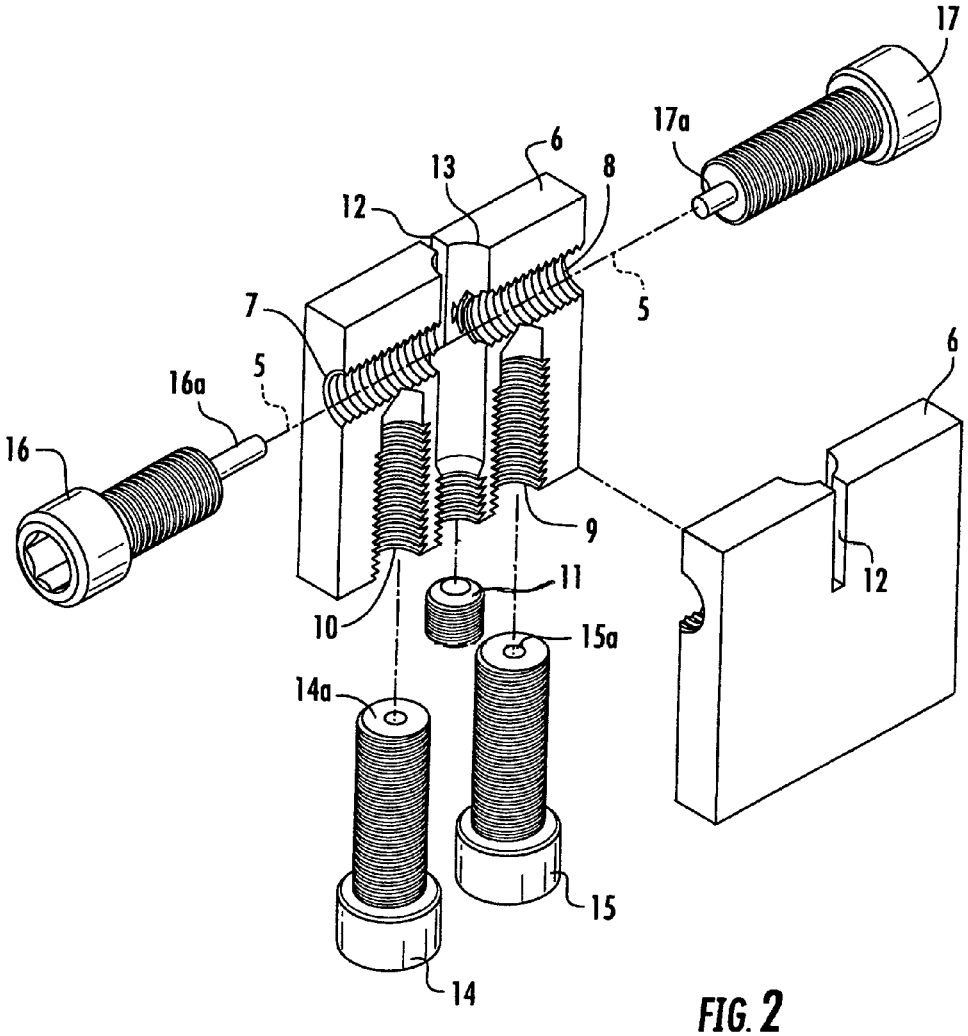
FIG. 2 is an exploded view of a preferred apparatus of the instant invention showing the body of the apparatus cross-sectioned to reveal the interior cavities of the body.

Referring now to FIG. 2, therein is shown an exploded view of a preferred apparatus of the instant invention showing the body 6 of the apparatus cross-sectioned to reveal the interior cavities of the body. The body 6 comprises a first bore therethrough, the first bore having a longitudinal axis 5, the body 6 having a second bore 13 therethrough, the second bore 13 having a longitudinal axis, the longitudinal axis of the first and second bores intersecting at a right angle within the body 6. The second bore 13 is threaded near one end while the first bore is threaded with threaded portions 7 and 8. The body 6 comprises a slot 12 aligned with and intersecting with the longitudinal axis of the second bore 13. The apparatus further comprises a first screw 11 adapted to be threaded into the threaded portion of the second bore 13. The body 6 further comprises a third threaded bore 9 thereinto and a fourth threaded bore 10 thereinto. The thread diameter and pitch of the first, third and fourth threaded bores are the same. The apparatus also comprises a second screw 14, a third screw 15, a fourth screw 17 and a fifth screw 16. The thread diameter and pitch of the second, third, fourth and fifth screws being the same as thread diameter and pitch of the first, third and fourth bores. The distal end 14*a* of the second screw 14 is flat. The distal end of the third screw 15 has a bore 15*a* thereinto along the longitudinal axis of the third screw 15. The distal end of the fourth screw 17 has a pin shaped projection 17*a* therefrom, the longitudinal axis of the pin shaped projection 17*a* from the fourth screw 17 being coincident with the longitudinal axis of the fourth screw 17, the length of the pin shaped projection 17*a* from the fourth screw 17 being less than the diameter of the second bore 13. The distal end of the fifth screw 16 comprises a pin shaped projection 16*a* therefrom, the longitudinal axis of the pin shaped projection 16*a* from the fifth screw 16 being coincident with the longitudinal axis of the fifth screw 16, the length of the pin shaped projection 16*a* from the fifth screw 16 being greater than the diameter of the second bore 13.

Referring still to FIG. 2, when a broadhead arrow tip employing retracting blades retained by a pin is positioned in the second bore 13 and the pin thereof is aligned with the longitudinal axis 5 of the first bore by adjusting the first screw 11 in the threaded portion of the second bore 13 to bear against the distal end of the arrow tip, the blades of the arrow tip can be positioned in the slot. When it is desired to remove the pin from the tip, the fifth screw 16 is screwed into the first bore from either side so that the pin shaped projection 16*a* from the fifth screw 16 presses the pin from the tip. When it is desired to only press the pin from the tip sufficiently to remove the blades from the tip for replacement with new blades, the fourth screw 17 is screwed into either side the second bore so that the pin shaped projection 17*a* from the fourth screw 17 presses the pin sufficiently to remove the blades from the tip for replacement with new blades after the screw 17 is backed out of the first bore so that the second screw 14 can then be screwed into the first bore to press the pin back into place flush with the body of the tip. Alternatively, when it is desired to press a new pin into the tip, a new pin can be positioned in the bore 15*a* of the third screw 15 and the third screw 15 can be screwed into the first bore to press the pin into the tip. The third and fourth threaded bores 9 and 10 are used for screw storage.

The preferred material of construction for the body is aluminum. The screws are preferably made of steel. It will be understood that other metals, polymers, composites or the like can be the material of construction for the body and/or the screws. The screws of the instant invention are shown in FIG. 2 as Allen head screws but such is not critical in the instant invention. For example, the screws of the instant invention can have ball ends for improved turning of the screws of the instant invention when turned by hand.

CONCLUSION

While the instant invention has been described above and claimed below according to its preferred embodiment, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains.

What is claimed is:

1. Apparatus for positioning a blade retaining pin of a broadhead arrow tip employing retracting blades retained by a pin, the apparatus comprising a body, the body comprising a first bore therethrough, the first bore having a longitudinal axis, the body having a second bore therethrough, the second bore having a longitudinal axis, the longitudinal axis of the first and second bores intersecting at a right angle, the first bore being threaded near one end, the second bore being threaded, the body comprising a slot aligned with and intersecting with the longitudinal axis of the first bore, the apparatus further comprising a first screw adapted to be threaded into a threaded portion of the first bore, the body further comprising a third threaded bore thereinto and a fourth threaded bore thereinto, the first, third and fourth threaded bores having a thread diameter and pitch, the thread diameter and pitch of the first, third and fourth threaded bores being the same, a second screw, a third screw, a fourth screw and a fifth screw, the thread diameter and pitch of the second, third, fourth and fifth screws being the same as thread diameter and pitch of the first, third and fourth bores, the second screw having a distal end, the distal end of the second screw being flat, the third screw having a longitudinal axis, the distal end of the third screw comprising a bore thereinto along the longitudinal axis of the third screw, the fourth screw having a distal end, the distal end of the fourth screw comprising a pin shaped projection therefrom, the pin shaped projection from the fourth screw having a longitudinal axis, the fourth screw having a longitudinal axis, the longitudinal axis of the pin shaped projection from the fourth screw being coincident with the longitudinal axis of the fourth screw, the pin shaped projection from the fourth screw having a length, the length of the pin shaped projection from the fourth screw being less than the diameter of the first bore, the fifth screw having a distal end, the distal end of the fifth screw comprising a pin shaped projection therefrom, the pin shaped projection from the fifth screw having a longitudinal axis, the longitudinal axis of the pin shaped projection from the fifth screw being coincident with the longitudinal axis of the fifth screw, the length of the pin shaped projection from the fifth screw being greater than the diameter of the first bore, so that a broadhead arrow tip having a distal end and employing retracting blades retained by a pin can be positioned in the first bore and the pin aligned with the longitudinal axis of the second bore by adjusting the first screw in the threaded portion of the first bore to bear against the distal end of the arrow tip with the blades of the arrow tip positioned in the slot, so that when it is desired to remove the pin from the tip, the fifth screw is screwed into the second bore so that the pin shaped projection from the fifth screw presses the pin from the tip, or so that when it is desired to only press the pin from the tip sufficiently to remove the blades from the tip for replacement with new blades, the fourth screw is screwed into the second bore so that the pin shaped projection from the fourth screw presses the pin sufficiently to remove the blades from the tip for replacement with new blades and then the second screw is screwed into the first bore to press the pin back into place, or so that when it is desired to press a new pin into the tip, a new pin can be positioned in the bore of the third screw and the third screw screwed into the first bore to press the pin into the tip, the third and fourth threaded bores being used for screw storage.

* * * * *